United States Patent [19]

von Zelewski et al.

[11] Patent Number: 4,892,225

[45] Date of Patent: Jan. 9, 1990

[54] COOLING CONTAINER FOR BUTTER OR THE LIKE

[76] Inventors: Andreas von Zelewski, Oranienburger Str. 24; Zenon Kapela, Fürstenberger Str. 41, both of 4000 Düsseldorf 13, Fed. Rep. of Germany

[21] Appl. No.: 143,131

[22] PCT Filed: Feb. 26, 1987

[86] PCT No.: PCT/EP87/00113

§ 371 Date: Nov. 2, 1987

§ 102(e) Date: Nov. 2, 1987

[30] Foreign Application Priority Data

Mar. 7, 1986 [DE] Fed. Rep. of Germany ..... 3607533

[51] Int. Cl.[4] ..... B65D 00/00

[52] U.S. Cl. ..... 220/408; 220/428; 220/337; 62/457

[58] Field of Search ..... 220/408, 426, 427, 428, 220/337, 338, 339; 62/457

[56] References Cited

U.S. PATENT DOCUMENTS

| | | | |
|---|---|---|---|
| 1,369,367 | 10/1930 | Thomson | 220/408 |
| 3,180,111 | 4/1965 | Rannenberg | 220/428 X |
| 4,630,671 | 12/1986 | Sherman | 62/457 X |

FOREIGN PATENT DOCUMENTS

| | | | |
|---|---|---|---|
| 809466 | 7/1951 | Fed. Rep. of Germany . | |
| 1529341 | 9/1969 | Fed. Rep. of Germany . | |
| 822434 | 12/1937 | France . | |
| 44370 | 9/1888 | German Democratic Rep. . | |
| 181625 | 3/1936 | Switzerland . | |
| 203667 | 6/1939 | Switzerland . | |
| 312737 | 6/1929 | United Kingdom | 220/428 |
| 319127 | 8/1934 | United Kingdom | 220/23 |

*Primary Examiner*—Harvey C. Hornsby
*Assistant Examiner*—K. O'Leary
*Attorney, Agent, or Firm*—Herbert Dubno

[57] ABSTRACT

A butter container or like container for preserving a foodstuff has an upwardly open receptacle forming the base, a plate at an upper part of this receptacle for holding the foodstuff and having a portion covered with an absorbent material dipping into water contained in the receptacle. The cover comprises a thin inner wall with an extension dipping into the water and covered on its outer surface with an absorbent material, an outer lid spaced from the inner wall, a water directing channel connecting the inner wall to the outer lid, and perforations in the lid through which water can be poured into the cover to pass via the channel into the receptacle.

4 Claims, 2 Drawing Sheets

COOLING CONTAINER FOR BUTTER OR THE LIKE

CROSS REFERENCE TO RELATED APPLICATIONS

This application is a national phase application of PCT/EP87/00113 filed 26 Feb. 1987 and based upon German national application P 36 07 533 filed 7 Mar. 1986 under the National Convention.

FIELD OF THE INVENTION

The invention relates to a cooling container for butter or the like consisting of a base which in its upper portion is shaped like a plate for receiving of a butter holder, and a cooling lid with a thin inner wall, to which an absorbent material in contact with a water storage container is applied. In such a container, butter can be kept at a relatively constant and low temperature, whereby its spreadability is preserved.

BACKGROUND OF THE INVENTION

Various cooling containers for butter are known (German Patent 44 370 and German Patent 809 466), wherein the lid has the shape of a bell or hood, supported on an insulated base and covered with absorbent. The bell can also be made of porous clay (German Utility Model 81 30 421).

In these types of containers, the water is soon evaporated. Also, the upkeep of the absorbent material creates problems. Since a protection cap over the wet layer is missing, these containers cannot meet the requirements of hygiene and aesthetics. When these containers are opened, there is a danger of the water being spilled and it is necessary to have a free, clean surface upon which the bell or the lid can be placed, so that the handling is cumbersome and not hygienic. Furthermore, an uncooled butter container with a removable lid, swingable at a hinge, is known (German open application 15 29 341).

The articulation consists of a hook-shaped latch mounted on the lid which engages in a slot in the butter container.

OBJECT OF THE INVENTION

The object of the invention is to provide a cooling container of the kind described, wherein frequent water refills are avoided and which nevertheless affords perfectly hygienic conditions and simple handling during the removal of the butter, the refilling with the water and the upkeep of the absorbent material.

SUMMARY OF THE INVENTION

This object is attained in a cooling container consisting of a base which in its upper portion is shaped like a plate for receiving of a butter holder, and a cooling lid with a thin inner wall, to which an absorbent material in contact with a water storage container is applied. According to the invention, the lower portion of the base is a water storage container, the cooling lid is insertable in the base and connected therewith by an articulation and the cooling lid has a perforated protection cap covering the absorbent material.

The advantages obtained due to the invention consist mainly in the fact that the water storage container is separated from the space reserved for the butter and that the cooling lid can be covered in a simple manner with absorbent material. The protection cap prevents a contamination of the absorbent material and a too rapid water evaporation, which meets the hygienic requirements.

The water reserve of approximately 0.6 l in the water storage container is sufficient for approximately 14 days.

According to the invention the inner wall of the cooling lid has a wide fin-like extension dipping into the water storage container and which is covered with the absorbent material of the cooling lid.

Due to the configuration, it is possible to replace easily the absorbent material. It is sufficient to wet a piece of sufficiently absorbent and properly sized paper towel and to put it on top of the lid and the fin-shaped extension. A simple construction of the colling container results when the fin-like extension is involved in the connection articulation.

The plate for receiving the butter holder can be a cooling bottom having a fin-like extension dipping into the water storage container, whereby the bottom side of the cooling plate and the extension are covered with an absorbent material; further the cooling bottom can be separated from the water storage container by a separation plate running at a distance from the bottom plate and that the lateral and frontal walls of the base can be provided with openings for water evaporation in the area between the separating plate and cooling bottom. In this construction an efficient cooling of the butter holder can be achieved from underneath. The inner wall of the cooling lid can be surrounded by a channel frontally on its outside, i.e. on the side which is facing away from the articulation connection, and laterally, this channel being provided for water evacuation and at the same time serving as a spacer between the inner wall and the outer protection cap. On the channel segment running along the frontal side of the cooling lid a handle can be provided. The channel has the advantage that water can be refilled when the container is closed, i.e. with the lid on, without the water reaching the goods to be cooled, when it is poured on top of the lid.

The cooling container is also well suited for keeping fresh foods such as cheese or sausage. It has been proven in practice that even sandwiches can maintain their freshness for hours in the cooling container, without becoming dry.

BRIEF DESCRIPTION OF THE DRAWING

The above and other objects, features and advantages of our invention will become more readily apparent from the following description, reference being made to the accompanying highly diagrammatic drawing in which.

DESCRIPTION

Figure 1:
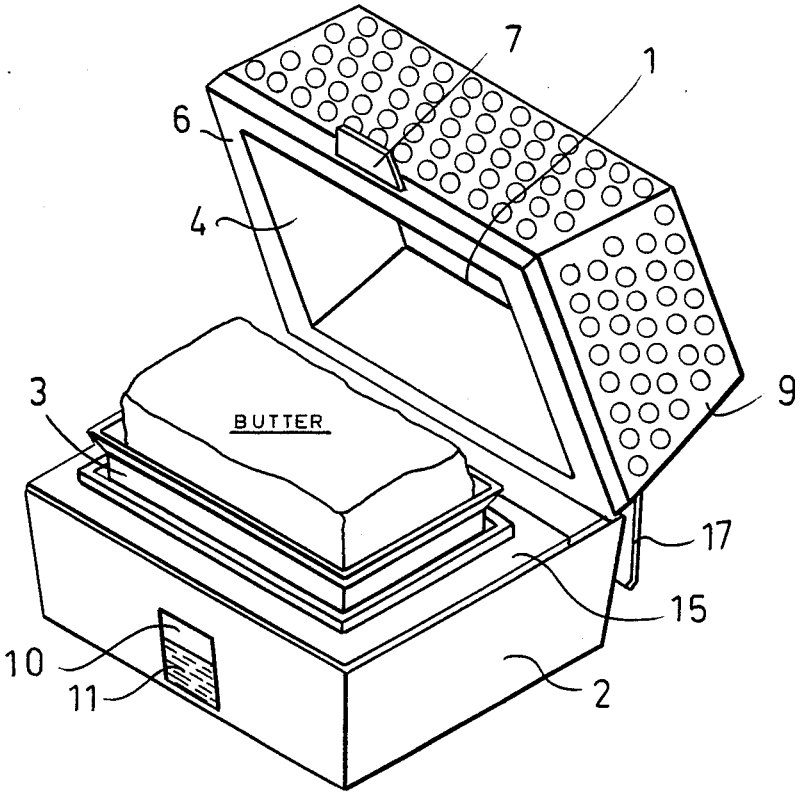
FIG. 1 is a perspective view of an open cooling container in a perspective view.
Figure 4:
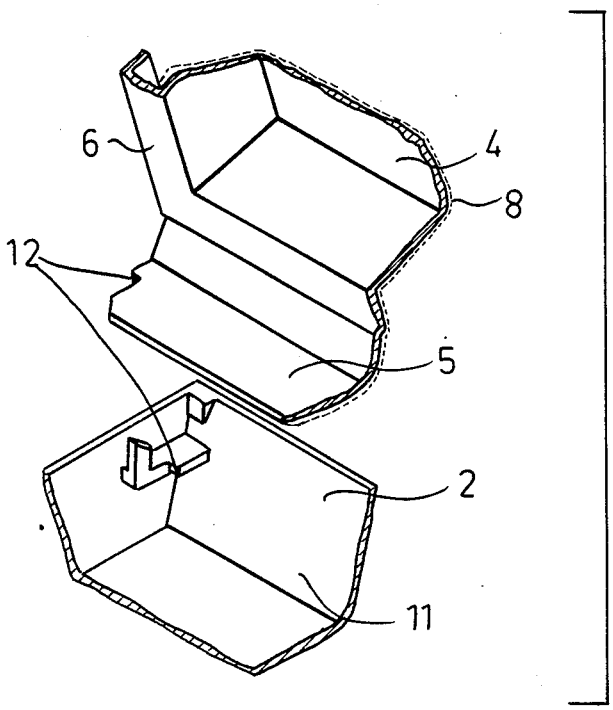
FIG. 4 is a partial cross section through the inner wall and the base with the connection articulation.

The cooling container for butter consists of a cooling lid 1, a base 2 and a butter holder 3. The cooling lid 1 consists of an inner wall 4, which is surrounded at the bottom, laterally and frontally by a channel 6 and has a fin-like extension 5 in the rear, which due to a corresponding configuration forms an easily attachable articulation 12, in connection with the base 2.

The inner wall 4 and the fin-like extension 5 are covered on their outsides with an absorbant material 8. On the outside of the frontal channel 6 a handle 7 is provided, in order to facilitate the opening and closing of the cooling lid 1.

On the outer edge of the channel 6, a detachable, perforated protection lid 9 is mounted, which protects the absorbant material 8 from contamination and rapid evaporation of the water. The base 2 is a water storage container 11, having a sight 10, through which the water level can be controlled. In order to refill the water has only to be poured onto the surface of the cooling lid.

The water collects in the channel 6 and can flow from there, over the fin-shaped extension 5, into the water storage container 11.

Figure 2:
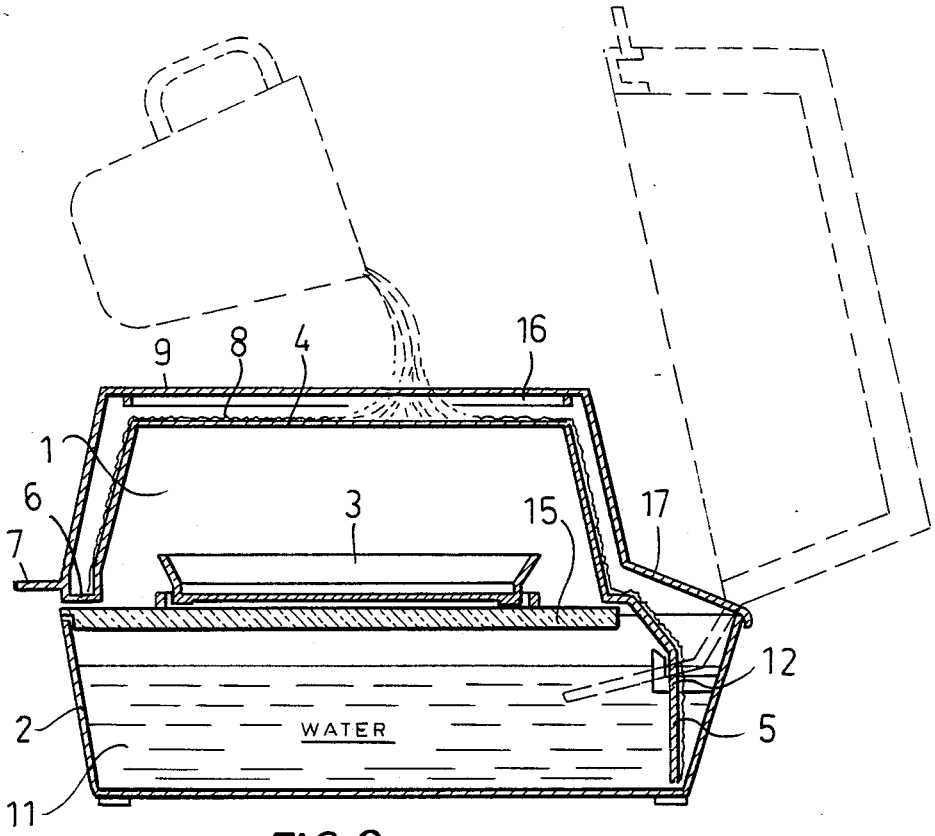
FIG. 2 is a cross section through a cooling container with a thermo-insulating plate
Figure 3:
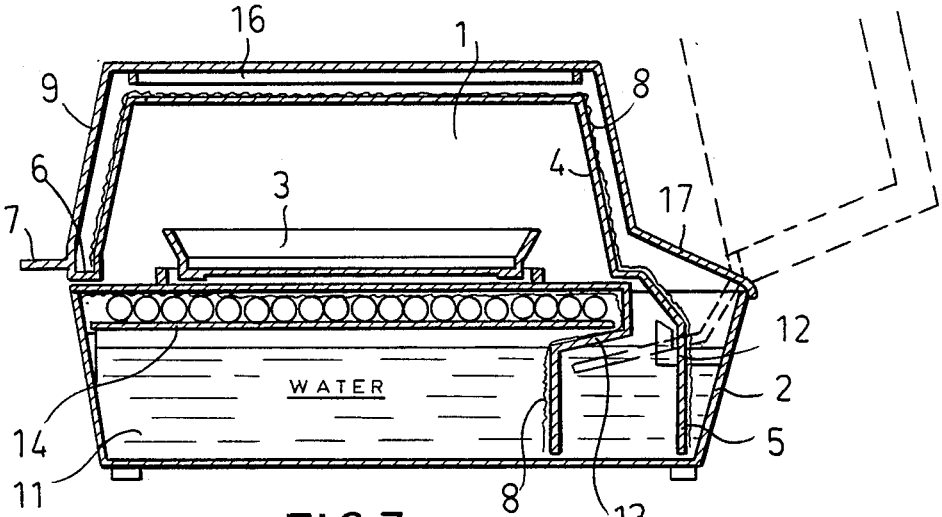
FIG. 3 is a cross section through a cooling container with a cooling bottom.

In the upper part of the base 2 a detachable bottom plate is mounted. This has a recess or a bulge for centering the butter holder and can be either a thermoinsulating plate 15 (FIG. 2) or a cooling bottom. In the latter case, the bottom plate is provided with a fin-like extension 13. The bottom plate and the extension are covered with absorbant material 8. The bottom plate is separated from the water by an insulating plate 14, whereby the base 2 is perforated on top, laterally and frontally (FIG. 3).

On the bottom plate a removable butter holder 3 can be fitted.

When the water storage container 11 is filled with water and the cooling lid is closed, the water is absorbed by the absorbant material 8 on the fin-like extension and distribution over the surface of the cooling lid, where it evaporates. Heat is thus removed from teh space under the cooling lid, so that the butter held thereunder is kept cool and maintains its spreadability.

We claim:

1. A cooling container for a food stuff, comprising:

an upwardly open receptacle forming a base for said container and adapted to hold a body of water;

a plate disposed above said body of water and mounted in an upper portion of said receptable for receiving a holder for said foodstuff on said plate, said plate having a side thereof covered with an absorbent material and an extension covered with said absorbent material extending downwardly from said plate into said body of water whereby water evaporating from said absorbent cools said foodstuffs on said plate; and a cover swingably mounted on said receptacle and concave in the direction of said receptacle to enclose said foodstuffs on said plate in a closed position of said cover, said cover comprising:

an inner wall externally lined with absorbent material and having an extension covered with absorbent material projecting into said receptacle and the body of water therein, an outer lid spaced from said inner wall and juxtaposed therewith, a channel interconnecting said outer lid and said inner wall around a portion of the periphery of said cover and adapted to direct flow of water introduced between said outer lid and said inner wall into said receptacle whereby water evaporating from the absorbent material on said inner wall cools said foodstuff in said closed position of said cover, perforations formed in said outer lid and communicating with the space between said outer lid and said inner wall for enabling evaporation from the absorbent material lining said inner wall and pouring of water through said perforations into said space for passage into said receptacle, and a peripherally extending drip edge around an upper part of said outer lid projecting downwardly in a closed position of said cover, and a cover cap extending outwardly from said outer lid at a rear portion of said container, said extension of said inner wall articulating said cover on said receptacle, said channel being formed at a front of the container with a handle.

2. The container defined in claim 1 further comprising a sight formed on a front wall of said receptacle for enabling viewing of a water level therein.

3. The container defined in claim 2 wherein said receptacle, said plate and said cover are composed of food-compatible synthetic material.

4. The container defined in claim 3 wherein said plate is formed with a recess for positioning said holder.

* * * * *